United States Patent [19]

Ramachandran

[11] 4,073,735

[45] Feb. 14, 1978

[54] RINSE CYCLE FABRIC SOFTENER

[75] Inventor: Pallassana Ramachandran, Robinsville, N.J.

[73] Assignee: Colgate Palmolive Company, New York, N.Y.

[21] Appl. No.: 659,603

[22] Filed: Feb. 19, 1976

[51] Int. Cl.[2] ..... D06M 13/34

[52] U.S. Cl. ..... 252/8.8; 8/115.6; 8/181; 252/8.6

[58] Field of Search ..... 252/8.8 AJ, 8.78, 8.6; 8/115.6, 181

[56] References Cited

U.S. PATENT DOCUMENTS

| | | | |
|---|---|---|---|
| 3,454,494 | 7/1969 | Clark et al. | 252/8.75 |
| 3,644,203 | 2/1972 | Lamberti et al. | 252/8.75 |
| 3,954,630 | 5/1976 | Ramachandran | 252/8.6 |

OTHER PUBLICATIONS

Gregory–Uses & Applications of Chemicals & Related Compounds–Reinhold Publ. Co. (1939) pp. 555–557.

*Primary Examiner*—William E. Schulz

*Attorney, Agent, or Firm*—Herbert S. Sylvester; Murray M. Grill; Norman Blumenkopf

[57] ABSTRACT

A rinse cycle fabric softening composition effective in reducing fabric discoloration consisting essentially of a cationic softening agent, preferably a quaternary ammonium softener, and an alkali metal silicate in the weight ratio of 4:3 to 4:1 of cationic:silicate.

11 Claims, No Drawings

RINSE CYCLE FABRIC SOFTENER

The present invention relates to a softening composition which effectively prevents the discoloration and/or yellowing of fabrics with no differentiation in the softening properties thereof.

The use of various and diverse chemical materials, and particularly cationic compounds as softeners for textile products, is very well known in the art. It is also well known to employ such materials for their softening effect during the laundering operation and particularly in the rinse cycle of the laundering process. This technique has been necessitated by the fact that the softeners heretofore employed, being mainly cationic in nature, are not compatible with the major type of detergent used in the washing cycle. By far, the predominating type of detergent used in home laundering processes is anionic in nature. It has been found that even traces of anionic materials results in a precipitate which greatly reduces the effectiveness of said cationic fabric softeners. This manifestation of incompatibility has necessitated the use of cationic quaternary softeners during laundering in the rinse cycle after several rinses to free said laundered fabrics of traces of anionic detergent.

Another serious disadvantage of cationic softening agents and particularly the quaternary ammonium compounds is the well known tendency of textiles treated therewith to yellow or discolor.

It has now been found that the addition of minor amounts of an alkali metal silicate salt, i.e. potassium or sodium silicate to cationic softening agents eliminates aforesaid yellowing and discoloration and enhances the whiteness of fabrics treated therewith, without adversely affecting the softening properties thereof. Instant composition may be used either in the wash or rinse cycle, but optimum results are obtained with rinse cycle use.

Accordingly, a primary object of this invention is the provision of a cationic fabric softening composition devoid of fabric discoloration tendencies.

Another object of this invention is to provide a rinse cycle fabric softening composition devoid of any yellowing tendency.

Still another object of this invention is to provide a fabric softening composition possessing superior whiteness properties.

Other objects will appear hereinafter as the description proceeds.

In accordance with the above objects, the fabric softening composition of this invention comprises a cationic softener and an alkali metal silicate salt in the weight ratio of 4:3 to 4:1 of softener:silicate.

The cationic fabric softening compounds useful in the composition of the present invention are commercially known and comprise cationic nitrogen containing compounds, such as quaternary ammonium compound and amines containing two straight chain organic radicals of at least 8 carbon atoms and preferably containing at least one straight chain organic radical containing from 12 to 22 carbon atoms, and more preferably two $C_{12}$ to $C_{22}$ radicals in the case of formulas (A) and (B) below.

Generally, the quaternary ammonium softening agents have the following formulae:

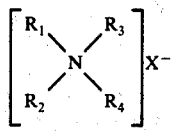

(A)

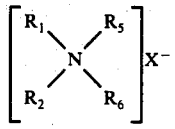

(B)

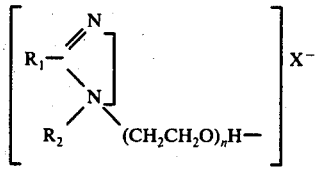

(C)

wherein $R_1$ is a long chain aliphatic radical having from 8 to 22 carbon atoms, $R_2$ is a long chained aliphatic radical having from 8 to 22 carbon atoms or is a lower alkyl raidcal having from 1 to 4 carbon atoms or an aryl or aralkyl radical, $R_3$ and $R_4$ are $C_1$ to $C_4$ alkyl radicals, $R_5$ is $—(CH_2CH_2O)_nH$ and $R_6$ is $R_3$ or $R_5$, $n$ is a number between 1 and 15 and X is a water soluble salt forming anion, such as a halide, i.e. chloride, bromide, iodide; a sulfate, acetate, hydroxide, methosulfate or similar inorganic or organic solubilizing mono- or dibasic radical. Examples of quaternary ammonium softening agents suitable for use in the composition of the present invention include the following: hydrogenated ditallow dimethyl ammonium chloride, ethoxylated (5E.O.) distearyl hydroxyethyl methyl ammonium chloride, 1-hydroxyethyl-1-methyl-2-heptadecyl imidazolinium chloride; dimethyl distearyl ammonium chloride; dimethyl distearyl ammonium bromide; cetyl, lauryl dimethyl ammonium chloride, di-coco dimethyl ammonium chloride; distearyl dimethyl quaternary ammonium methylsulfate; dicoco dimethyl quaternary ammonium chloride; dimethyl arachidyl, behenyl quaternary ammonium chloride; di-(soya) dimethylammonium chloride, and di(coco) dimethylammonium chloride, etc.

Examples of amines which may be utilized in the composition of the present invention include primary tallow amine, primary coco amine, primary halogenated tallow amine, n-tallow 1,3-propylene diamine, oleyl 1,3-propylene diamine, and coco 1,3-propylene diamine.

The term "coco" when utilized refers to fatty acid groups formed in coconut oil fatty acids. Such acids contain from about 8 to 18 carbon atoms per molecule predominating in the $C_{12\text{-}14}$ acid.

An essential ingredient in instant softening composition is an alkali metal silicate salt. The silicate salts found most useful herein as an effective anti-yellowing agent with cationic fabric softeners are the alkali metal salts such as sodium and potassium silicate having a molar ratio of $Na_2O$: $SiO_2$ of 1:1.6 to 1:3.2 and preferably 1:2.35. The alkali metal silicate salts may be in the form of a free-flowing powder or in the form of an aqueous solution when admixed with the cationic softener.

Although it is well known that conventional cationic fabric softeners tend to cause yellowing and discoloration of fabrics, it has nevertheless been found that minor amounts of aforesaid alkali metal silicate admixed with aforesaid cationic softeners unexpectedly reduces and/or eliminates said fabric yellowing and discoloration and enhances the whitening properties thereof, without interfering with the softening properties of said cationic fabric softeners. The strong affinity of cationic fabric softeners to fabric yields superior softening properties but has the disadvantage of building up on the fabric, thereby causing undesirable yellowing normally associated therewith. It has been found that the presence of minor amounts of alkali metal silicates substantially decreases the tendency of build-up of the cationic agent on the fabric, thereby eliminating yellowing. Similarly, the presence of organometallic complexes (color bodies) in the wash and especially in the rinse water, which is believed to be the major cause of fabric discoloration, is effectively prevented from depositing on the fabric due to the presence of minor amounts of the alkali silicate in the cationic softening composition. Weight ratios of 4:3 to 4:1 of cationic:silicate appear to be most effective as a non-yellowing softening composition. Larger amounts of silicate interfere with the softening properties of the composition, whereas smaller amounts of silicate are ineffective as a non-yellowing agent.

The process of treating fabrics with instant softening compositions is not dependent on temperature and performs well with either cold or warm rinse solutions. Also, the process can be conducted using water of any reasonable degree of hardness although obviously, the use of softer rinse water is preferred.

The softening composition of instant invention may also include minor amounts of brighteners, bluing, germicides, perfumes, diluents or other additives which do not interfere with the softening, and whitening properties of said composition.

This product may be prepared by simply admixing the ingredients. It may be dry blended or be prepared in liquid form such as an aqueous solution. A specific method comprises the admixing of a 43–45% aqueous sodium silicate solution with quaternary ammonium compound in powder form, adding a small amount of lower aliphatic alcohol such as isopropyl alcohol to solubilize the powdered softener and reduce the viscosity of the aqueous solution. The softening composition may be used as such or spray dried into beads, powder, etc. The product may be formed into pellets or other suitable shape.

The invention has found its greatest utility thus far in the softening of cotton fabrics, fabrics made of other cellulosic fibers, e.g., rayon or other textile fibers, e.g., nylon, silk, wool, polyethylene terephthalate, cellulose acetate, acrylonitrile polymers or copolymers, or blends of any two or more of these fibers (e.g., cotton-polyester blends). This softening composition may be applied to the fabric in an aqueous bath, either as a final rinse during laundering, since a major portion of the deposition of color bodies on the fabric occurs during the rinse cycle; or as a separate and distinct softening operation. In addition, since this softening composition is compatible with anionic and non-ionic detergents, it may be added to the wash water during laundering. However, optimum whiteness is obtained when utilized in the rinse cycle of laundering. In use, 30 to 60g of the softening composition is added to an automatic washing machine or similar treating bath containing 17 gallons (35 liters) of water, and an average load of fabrics (about 6 to 8 pounds). However, lesser or greater amounts may be utilized to obtain the desired degree of softness, whiteness, depending on the water temperature, the water hardness, the amount of water and clothes, etc.

The following examples are given to further illustrate this invention. All parts given are by weight unless otherwise indicated. In the Examples, the pressure is atmospheric unless otherwise indicated.

EXAMPLE 1

Several swatches of cotton terry towel, cotton PP and Polyester/cotton PP (PP — Permanent Press finish) are washed once and rinsed once in water containing 1ppm each of $Fe^{+++}$, $Cu^{++}$, $Mn^{++}$ and 150 ppm of Ca/Mg hardness calculated as $CaCO_3$ and 5 ppm of tannic acid (model organic impurity found in water) at 120° F. Said swatches are washed with an aqueous solution of a heavy duty detergent comprising 10% sodium linear tridecyl benzene sulfonate, 2% $C_{14}$–$C_{15}$ fatty alcohol with an average of 11 ethylene oxide groups, 2% mixed sodium coconut/Tallow fatty acid soap, 35% pentasodium tripolyphosphate, 7% sodium silicate ($Na_2O$:$SiO_2$ ratio 1:2.35), 0.5% sodium carboxymethyl cellulose and the balance sodium sulfate in the concentration of 1g/liter of aforedefined water. Said washed fabrics are subsequently rinsed with instant softening composition comprising 0.1g distearyl dimethyl ammonium chloride and 0.075g sodium silicate ($Na_2O$:$SiO_2$ 1:2.35 per litter of water. The effectiveness of the rinse composition is determined by reflectance readings (Rd) on the fabrics after rinsing, using a Gardner Color Difference Meter, wherein higher Rd values is indicative of increased whiteness and higher "*rb*" values indicates greater yellowness whereas higher "$-b$" values represents more whitening. The *b* scale goes from blue to white to yellow ($-b$–$+b$).

TABLE I

| Fabric | distearyl dimethyl quaternary ammonium chloride | quaternary + sodium silicate |
|---|---|---|
| | Final Rd | Final Rd |
| Cotton Terry Towel | 69.3 | 72.2 |
| Polyester/cotton PP | 69.4 | 72.8 |
| Cotton PP | 69.0 | 73.7 |

The increased whiteness is clearly evident with the composition of instant invention, wherein the amount of sodium silicate is 0.075 g/l of rinse water and the weight ratio of cationic to silicate is 4:3 respectively.

EXAMPLE 2 AND 3

Softening compositions containing 0.05g/l and 0.025g/l of sodium silicate, wherein the weight ratio of cationic to sodium silicate is 4:2 and 4:1 respectively (Example 2 and Example 3) also yield whiter fabrics as evidenced by the following "Rd" readings:

TABLE II

| Fabric | Example 2 | Example 3 |
|---|---|---|
| | Final Rd | Final Rd |
| Cotton Terry Towel | 72.2 | 68.5 |
| Polyester/cotton PP | 72.3 | 72.0 |
| Cotton PP | 72.3 | 71.4 |

It is apparent from the above results that sodium silicate in an amount as low as 0.025g/l of rinse water effects increased whiteness even after only one rinse. Softness ratings of duplicate swatches of terry towels of Example 3 were $10^{4+}$, and $10^{4+}$ as compared to $10^{3+}$ and $10^{4+}$ for towels rinsed with the softener of Example 1 per se. Thus, it is apparent that amounts as low as 0.025g/l of sodium silicate significantly reduces the fabric discoloration, particularly on permanent press finish fabrics without interfering with the softness of terry towels.

EXAMPLE 4

Tallow alkyl propylene diamine was substituted for the distearyl dimethyl quaternary ammonium chloride in the rinse water of Example 1. Some beneficial effect on reducing color body deposition (fabric discoloration) is noted herewith, without interfering with the softening properties thereof.

In the most preferred embodiment the softening composition is provided as an aqueous solution with, if desired for viscosity and/or solubilizing considerations, a viscosity control and/or solubilizing agent such as alcohols or urea (1–25%). Such aqueous solutions may contain from about 1 to 25% cationic softener with 2 to 20% preferred and 2.5% to 15% most preferred with appropriate amount silicate within the disclosed ratio of 4:3 to 4:1 cationic to silicate.

Within the aforementioned concentrations, the compositions of this invention will provide at the generally used dosage levels of 30 to 60 grams of softening composition concentrations of cationic of from about 0.005 g/liter to 0.20 g/liter. Preferred usage levels in the bath range from about 0.03 g/liter to 0.1 g/liter. It is, of course, clear that where the more highly concentrated compositions are used the dosage may be reduced below the usual 30 gram/load to provide the desired levels of ingredients in the treatment bath or rinse cycle of the washing machine.

As is apparent from the foregoing examples, the composition and process of the present invention provides a softening composition which reduces the yellowing caused by cationic softening agents and increases whiteness with no apparent differentiation in the degree of softening.

While various preferred embodiments of the present invention have been illustrated by means of specific examples, it is to be understood that the present invention is in no way to be deemed as limited thereto, but should be construed as broadly as all or any equivalents thereof.

What is claimed is:

1. A fabric-softening composition especially effective in the rinse cycle for reducing fabric discoloration consisting essentially of cationic softener and alkali metal silicate in the weight ratio of 4:3 to 4:1 of cationic:silicate, said silicate having an $Na_2O$ to $SiO_2$ ratio of from 1:1.6 to 1:3.2.

2. An aqueous solution of a fabric-softening composition of claim 1 and comprising from about 1–25% of cationic softener and about 1–20% of alkali metal silicate salt and the remainder water.

3. A fabric-softening composition of claim 2, wherein the cationic softener is a di-$C_8$ to $C_{22}$ di-$C_1$ to $C_4$ quaternary ammonium compound.

4. A fabric-softening composition of claim 3, wherein the cationic quaternary softener is distearyl dimethyl quaternary ammonium chloride.

5. A fabric-softening composition of claim 2 wherein the cationic softener is an imidazolinium compound.

6. A fabric softening composition of claim 2 wherein the cationic softener is tallow alkyl propylene diamine.

7. A fabric-softening composition of claim 2, wherein the silicate salt is sodium silicate.

8. A method of softening fabrics which comprises applying to said fabrics in an aqueous bath, an amount sufficient to soften the fabric, of the composition of claim 2.

9. The method of claim 8, wherein the softening composition of claim 3 is added as a final rinse during laundering.

10. In the process of softening fabrics in water, the improvement which comprises adding to the water the composition of claim 2, in an amount sufficient to soften said fabrics.

11. In the process of softening fabrics in water, the improvement which comprises adding to the water the composition of claim 1 in an amount sufficient to soften said fabrics.

* * * * *